US005704001A

United States Patent [19]

Gardner

[11] Patent Number: 5,704,001

[45] Date of Patent: Dec. 30, 1997

[54] SENSITIVITY WEIGHTED VECTOR QUANTIZATION OF LINE SPECTRAL PAIR FREQUENCIES

[75] Inventor: William R. Gardner, San Diego, Calif.

[73] Assignee: QUALCOMM Incorporated, San Diego, Calif.

[21] Appl. No.: 286,150

[22] Filed: Aug. 4, 1994

[51] Int. Cl.[6] ..... G10L 9/14

[52] U.S. Cl. ..... 395/2.28; 395/2.25; 395/2.18; 395/2.39

[58] Field of Search ..... 395/2.25, 2.26, 395/2.27, 2.28, 2.31, 2.36, 2.39

[56] References Cited

FOREIGN PATENT DOCUMENTS 2131659 6/1984 United Kingdom .
9315502 1/1993 WIPO ..... G10L 9/02

OTHER PUBLICATIONS

Frank K. Soong and Biing-Hwang Juang, "Optimal Quantization of LSP Parameters Using Delayed Decisions", ICASSP '90 Proceedings, 1990.

Frank K. Soong and Biing-Hwang Juang "Line Spectrum Pair (LSP) and Speech Data Compression", ICASSP '84 Proceedings, 1984.

William Robert Gardner, Modeling and Quantization Techniques for Speech Compression Systems, Ph.D. dissertation, University of California, San Diego, 1994.

Lawrence Rabiner and Biing-Hwang Juang, Fundamentals of Speech Recognition, Prentice-Hall, pp. 123, 171-172, 1993.

Jianping Pan et al. "Vector Quantization of Speech LSP Parameters Using Trellis Codes and 11-Norm Constraints", *IEEE International Conference on Acoustics, Speech, and Signal Processing*, vol. II of V, Apr. 27-30, 1993, pp. II-17-20.

Maurizio Omologo, "The Computation and Some Spectral Considerations on Line Spectrum Pairs (LSP)", *IEEE European Conference on Speech Communication and Technology*, vol. Two, Sep. 1989, pp. 352-255.

Yuval Bistritz et al., "Immittance Spectral Pairs (ISP) for Speech Encoding", *IEEE International Conference on Acoustics, Speech, and Signal Processing*, vol. II of V, Apr. 27-30, 1993, pp. II-9-12.

Frank K. Soong et al., "Line Spectrum Pair (LSP) and Speech Data Compression", *Institute of Electrical and Electronics Engineers*, vol. 1, Mar. 19-21, 1984, pp. 1.10.1-1.10.4.

Frank K. Soong et al., "Optimal Quantization of LSP Parameters", *IEEE Transactions on Speech and Audi Processing*, vol. 1, No. 1., Jan. 1, 1993, pp. 15-24.

Rajiv Laroia et al., "Robust and Efficient Quantization of Speech LSP Parameters Using Structured Vector Quantizers", *IEEE International Conference on Acoustics, Speech, and Signal Processing*, vol. 1, May 14-17, 1991, pp. 641-644.

(List continued on next page.)

*Primary Examiner*—Allen R. MacDonald
*Assistant Examiner*—Tālivaldis Ivars Šmits
*Attorney, Agent, or Firm*—Russell B. Miller; Sean English; Linli L. Golden

[57] ABSTRACT

A novel and improved method and apparatus for quantizing the line spectral pair (LSP) frequencies in a speech compression system is disclosed. A novel and computationally efficient procedure for determining the set of quantization sensitivities for the LSP frequencies is disclosed, which results in a computationally efficient error measure for use in vector quantization of the LSP frequencies. A novel method of weighting the quantization error is disclosed, which accumulates the quantization error in each LSP frequency and weights that error by the sensitivity of that LSP frequency.

33 Claims, 2 Drawing Sheets

OTHER PUBLICATIONS

C.-C. Kuo et al. "New LSP Encoding Method Based on Two-Dimensional Linear Prediction", *IEE Proceeding-I*, vol. 140, No. 6, Dec. 1993, pp. 415-419.

K.K. Paliwal et al. "Efficient Vector Quantization of LPC Parameters at 24 Bits/Frame", *IEEE Transactions on Speech, and Audio Processing*, vol. 1, No. 1, Jan., 1993, pp. 3-14.

K.K. Paliwal et al. "Efficient Vector Quantization of LPC Parameters at 24 Bits/Frame", *IEEE International Conference on Acoustics, Speech and Signal Processing*, vol. 1, May 14-17, 1991, pp. 661-664.

SENSITIVITY WEIGHTED VECTOR QUANTIZATION OF LINE SPECTRAL PAIR FREQUENCIES

BACKGROUND OF THE INVENTION

I. Field of the Invention

The present invention relates to speech processing. More particularly, the present invention relates to a novel and improved method and apparatus for quantizing the line spectral pair (LSP) information in a linear prediction based speech coding system.

II. Description of the Related Art

Transmission of voice by digital techniques has become widespread, particularly in long distance and digital radio telephone applications. This, in turn, has created interest in devising methods for minimizing the amount of information transmitted over a channel while maintaining the quality of the speech reconstructed from said information. If speech is transmitted by simply sampling and digitizing, a data rate on the order of 64 kilobits per second (kbps) is required to achieve a reconstructed speech quality similar to that of a conventional analog telephone. However, through the use of speech analysis, followed by the appropriate coding, transmission, and resynthesis at the receiver, a significant reduction in the data rate can be achieved.

Devices which employ techniques to compress voiced speech by extracting parameters that relate to a model of human speech generation are typically called vocoders. Such devices are composed of an encoder, which analyzes the incoming speech to extract the relevant parameters, and a decoder, which resynthesizes the speech using the parameters which it receives over the transmission channel. To accurately track the time varying speech signal, the model parameters are updated periodically. The speech is divided into blocks of time, or analysis frames, during which the parameters are calculated and quantized. These quantized parameters are then transmitted over a transmission channel, and the speech is reconstructed from these quantized parameters at the receiver.

Of the various classes of speech coders, the Code Excited Linear Predictive Coding (CELP), Stochastic Coding, or Vector Excited Speech Coding coders are of one class. An example of a coding algorithm of this particular class is described in the paper "A 4.8 kbps Code Excited Linear Predictive Coder" by Thomas E. Tremain et al., *Proceedings of the Mobile Satellite Conference,* 1988. An example of a particularly efficient vocoder of this type is detailed in U.S. Pat. No. 5,414,796 issued May 9, 1995, entitled "Variable Rate Vocoder" and assigned to the assignee of the present invention and is incorporated by reference herein. The vocoder of the aforementioned patent application describes a CELP coder that provides a variable data rate speech coding.

Many speech compression algorithms use a filter to model the spectral magnitude of the speech signal. The coefficients of the filter are computed for each frame of speech using linear prediction based techniques, and thus the filter is referred to as the Linear Predictive Coding (LPC) filter. Once the filter coefficients have been determined, the filter coefficients must be quantized into a finite number of bits. Efficient methods for quantizing the LPC filter coefficients can result in a decrease in the bit rate required to compress the speech signal.

One method for quantizing LPC parameters involves transforming the LPC parameters to Line Spectral Pair (LSP) parameters. LSP parameters statistically have better quantization properties than LPC parameters. Thus, LSP parameters are typically used for quantization of the LPC filter. For a particular set of LSP parameters, quantization error in one parameter may result in a larger perceptual effect than a similar quantization error in another LSP parameter. The perceptual effect of quantization can be minimized by allowing more quantization error in LSP parameters which are less sensitive to quantization error. To determine the optimal distribution of quantization error, the individual sensitivity of each LSP parameter must be determined.

Although the sensitivities of the LSP parameters have been described previously (for example, in "Optimal Quantization of LSP Parameters," by F. K. Soong and B. H. Juang in *Proceedings of IEEE Conference on Acoustics, Speech, and Signal Processing,* 1988), there have been no closed form expressions for determining the sensitivities described in the prior art, and only computationally expensive techniques have been previously described.

SUMMARY OF THE INVENTION

The present invention is a novel and improved method and apparatus for quantizing the LPC filter coefficients. The present invention transforms the LPC filter coefficients into a set of line spectral pair (LSP) frequencies. The sensitivity of each LSP frequency is then computed using a novel and efficient method. The present invention describes a computationally efficient method for computing these sensitivities without the use of numerical integration techniques, greatly reducing the complexity required. Once the sensitivities are computed, the differences between the LSP frequencies are computed and partitioned into subsets, or subvectors. Each subvector of LSP frequency differences is then quantized by determining which codevector of LSP frequency differences selected from a codebook of LSP frequency difference vectors minimizes the sensitivity weighted error between the codevector and the original subvector. Improved performance is achieved by vector quantizing the subvectors of LSP frequency differences, and through the use of the sensitivity weighted error measure.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
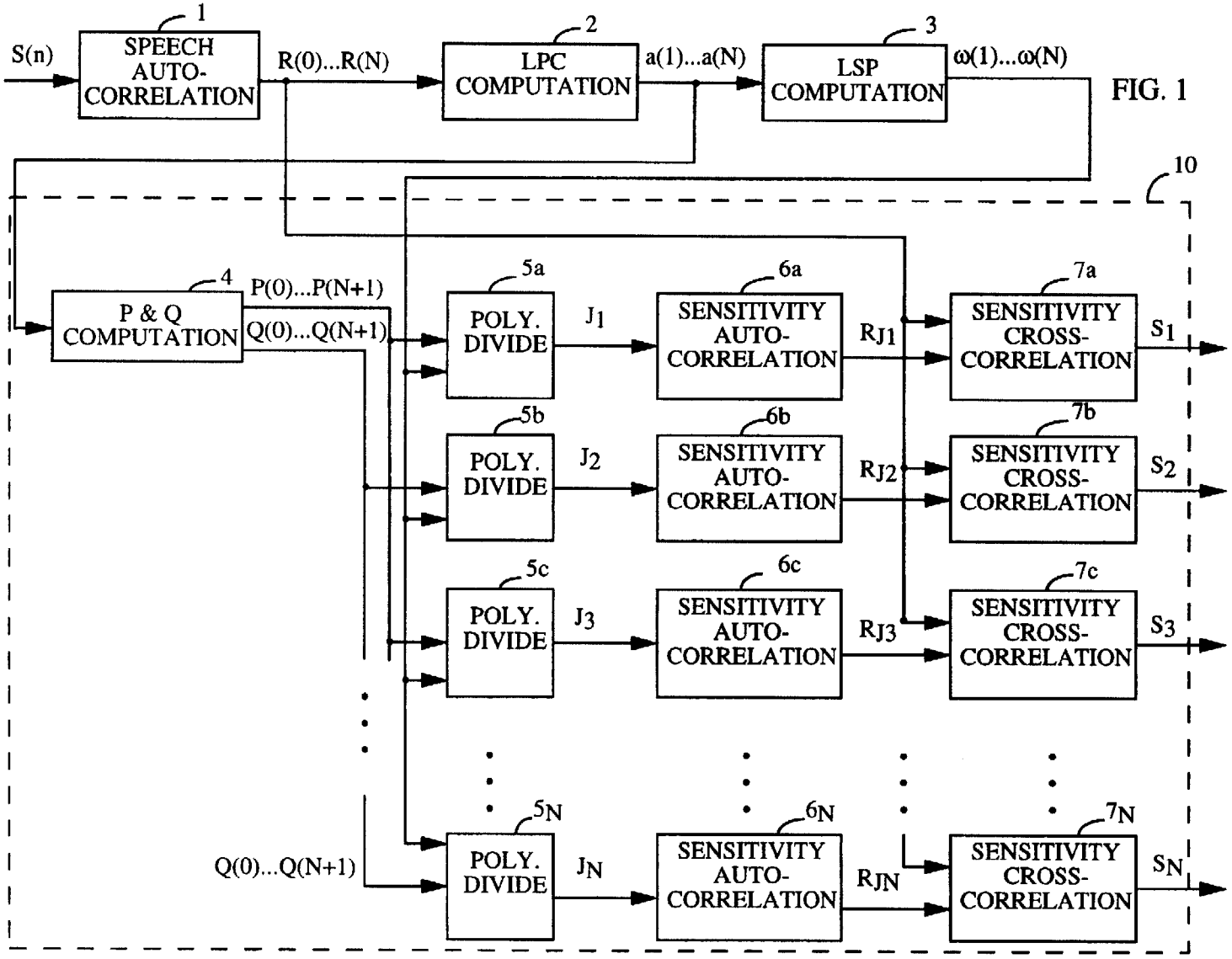
FIG. 1 is a block diagram illustrating the efficient computation of the sensitivities of the LSP frequencies.

FIG. 1 illustrates the apparatus of the present invention for determining the LPC coefficients (a(1),a(2), . . . , a(N)), the LSP frequencies (ω(1),ω(2), . . . ,ω(N)), and the quantization sensitivities of the LSP frequencies ($S_1$,$S_2$, . . . ,$S_N$). N is the number of filter taps in the formant filter for which the LPC coefficients are being derived. Speech autocorrelation element 1 computes a set of autocorrelation values, R(0) to R(N), from the frame of speech samples, s(n) in accordance with equation 1 below:

$$R(n) = \sum_{k=1}^{L+1-n} s(k) \cdot s(k+n) \tag{1}$$

,where L is the number of speech samples in the frame over which the LPC coefficients are being calculated. In the exemplary embodiment, the number of samples in a frame is 160, L=160. In the exemplary embodiment, the LPC filter has ten taps, N=10.

Linear prediction coefficient (LPC) computation element 2 computes the LPC coefficients, a(1) to a(N), from the set of autocorrelation values, R(0) to R(N). The LPC coefficients may be obtained by the autocorrelation method using Durbin's recursion as discussed in *Digital Processing of Speech Signals*, Rabiner & Schafer, Prentice-Hall, Inc., 1978. This technique is an efficient computational method for obtaining the LPC coefficients. The algorithm can be stated in equations 2–7 below:

$$E^{(0)}=R(0),\ i=1; \tag{2}$$

$$k_i=\left\{ R(i)-\sum_{j=1}^{i-1}\alpha_j^{(i-1)}R(i-j) \right\} /E^{(i-1)}; \tag{3}$$

$$\alpha_i^{(i)}=k_i; \tag{4}$$

$$\alpha_j^{(i)}=\alpha_j^{(i-1)}-k_i\alpha_{i-j}^{(i-1)} \text{ for } 1<=j<=i-1; \tag{5}$$

$$E^{(i)}=(1-k_i^2)E^{(i-1)}; \text{ and} \tag{6}$$

$$\text{If } i<N \text{ then go to equation (3) with } i=i+1. \tag{7}$$

The N LPC coefficients are labeled $\alpha_j^{(N)}$, for 1<=j<=N. The operations of both element 1 and 2 are well known. In the exemplary embodiment, the formant filter is a tenth order filter, meaning that 11 autocorrelation values, R(0) to R(10), are computed by element 1, and 10 LPC coefficients, a(1) to a(10), are computed by element 2.

LSP computation element 3 converts the set of LPC coefficients into a set of LSP frequencies of values ω1 to ωN. The operation of element 3 is well known and is described in detail in the aforementioned U.S. Pat. No. 5,414,796. In order to efficiently encode each of the LPC coefficients in a small number of bits, the coefficients are transformed into Line Spectrum Pair frequencies as described in the article "Line Spectrum Pair (LSP) and Speech Data Compression", by Soong and Juang, ICASSP '84. The computation of the LSP parameters is shown below in equations (8) and (9) along with Table I.

The LSP frequencies are the N roots which exist between 0 and π of the following equations:

$$p(\omega)= \tag{8}$$

$$\cos\frac{N}{2}\omega+p_1\cos\left[\left(\frac{N}{2}-1\right)\cdot\omega\right]+\ldots+p_{N/2-1}\cos\omega+\frac{p_{N/2}}{2}$$

$$q(\omega)= \tag{9}$$

$$\cos\frac{N}{2}\omega+q_1\cos\left[\left(\frac{N}{2}-1\right)\cdot\omega\right]+\ldots+q_{N/2-1}\cos\omega+\frac{q_{N/2}}{2}$$

,where the $P_n$ and $q_n$ values for n=1, 2, . . . N/2 are defined recursively in Table I.

TABLE I

| | |
|---|---|
| $p_1=-(a(1)+a(N))-1$ | $q_1=-(a(1)-a(N))+1$ |
| $p_2=-(a(2)+a(N-1))-p_1$ | $q_2=-(a(2)-a(N-1))+q_1$ |
| $p_3=-(a(3)+a(N-2))-p_2$ | $q_3=-(a(3)-a(N-2))+q_2$ |
| . | . |
| . | . |
| . | . |

In Table I, the a(1), . . . , a(N) values are the scaled coefficients resulting from the LPC analysis. The N roots of equations (8) and (9) are scaled to between 0 and 0.5 for simplicity. A property of the LSP frequencies is that, if the LPC filter is stable, the roots of the two functions alternate; i.e. the lowest root, $\omega_1$, is the lowest root of p(ω), the next lowest root, $\omega_2$, is the lowest root of q(ω), and so on. Of the N frequencies, the odd frequencies are the roots of the p(ω), and the even frequencies are the roots of the q(ω).

P & Q computation element 4 computes two new vectors of values, $\vec{P}$ and $\vec{Q}$, from the LPC coefficients, using the following equations 10–15:

| | | |
|---|---|---|
| P(0) = 1 | | (10) |
| P(N+1) = 1 | | (11) |
| P(i) = −a(i) − a(N+1−i) | 0<i<N+1 | (12) |
| Q(0) = 1 | | (13) |
| Q(N+1) = −1 | | (14) |
| Q(i) = −a(i) + a(N+1−i); | 0<i<N+1 | (15) |

Polynomial division elements 5a–5N perform polynomial division to provide the sets of values $\vec{J}_i$, composed of $J_i(1)$ to $J_i(N)$, where i is the index of the LSP frequency of interest. For the LSP frequencies with odd index ($\omega_1$, $\omega_3$, etc.), the long division is performed as:

$$x^2-2\cdot\cos(\omega_i)\cdot \tag{16}$$

$$x+1\ \overline{\left)\ J_i(N-1)x^{N-1}+J_i(N-2)x^{N-2}+\ldots+J_i(1)x+J_i(0)\right.}$$

$$P(N+1)x^{N+1}+P(N)x^N+\ldots+P(1)x+P(0)$$

and for the LSP frequencies with even index ($\omega_2$,$\omega_4$, etc.), the long division is performed as $$x^2-2\cdot\cos(\omega_i)\cdot \tag{17}$$

$$x+1\ \overline{\left)\ J_i(N-1)x^{N-1}+J_i(N-2)x^{N-2}+\ldots+J_i(1)x+J_i(0)\right.}$$

$$Q(N+1)x^{N+1}+Q(N)x^N+\ldots+Q(1)x+Q(0)$$

If i is odd, $J_i(k)=J_i(N+1-k)$, and because of this symmetry only half of the division needs to be performed to determine the entire set of N $J_i$ values. Similarly, if i is even, $J_i(k)=-J_i(N+1-k)$, and because of this anti-symmetry only half of the division needs to be performed.

Sensitivity autocorrelation elements 6a–6N compute the autocorrelations of the sets $\vec{J}_i$, using the following equation:

$$R_{Ji(n)}=\sum_{k=0}^{N-n-1} J_i(k)\cdot J_i(k+n). \tag{18}$$

Sensitivity cross-correlation elements 7a–7N compute the sensitivities for the LSP frequencies by cross correlating the $\vec{R}_{Ji}$ sets of values with the autocorrelation values from the speech, $\vec{R}$, and weighting the results by $\sin^2(\omega_i)$. This operation is performed in accordance with equation 19 below:

$$S_i=\sin^2(\omega_i)\cdot\left[R(0)\cdot R_{Ji}(0)+2\cdot\sum_{k=1}^{N}R(k)\cdot R_{Ji}(k)\right] \tag{19}$$

Figure 2:
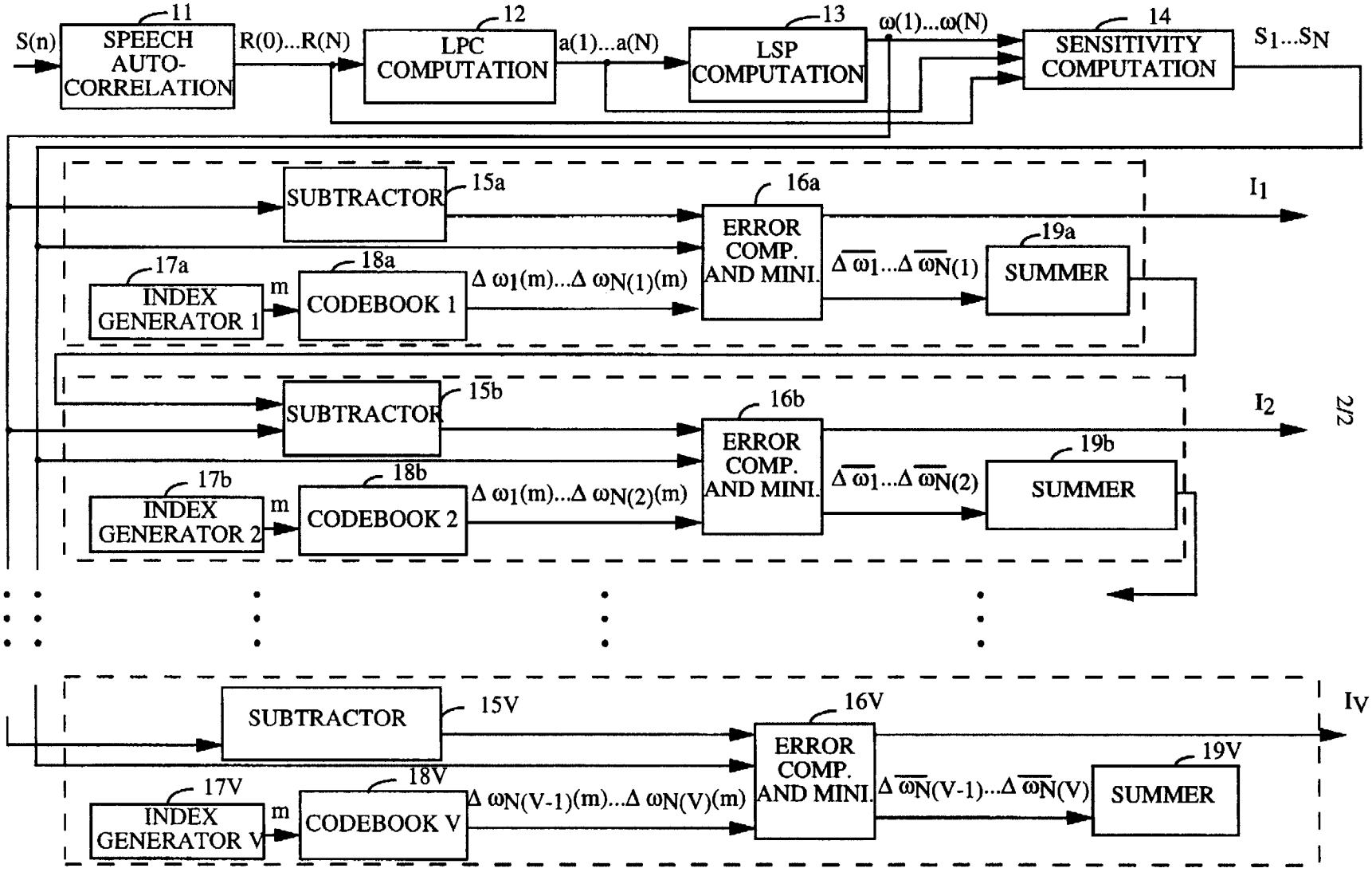
FIG. 2 is a block diagram illustrating the overall quantization mechanism.

FIG. 2 illustrates the apparatus of the present invention for the quantization of the set of LSP frequencies. The present invention can be implemented in a digital signal processor (DSP) or in an application specific integrated circuit (ASIC). Elements 11, 12, 13, and 14 operate as described above for blocks 1, 2, 3 and 10 of FIG. 1. Once the set of LSP frequencies, $\vec{\omega}$, and the set of sensitivities, $\vec{S}$, are computed, the quantization of the LSP frequencies begins. A first subvector of LSP differences, comprising $\Delta\omega_1, \Delta\omega_2, \ldots \Delta\omega_{N(1)}$, is computed by subtractor elements 15a as:

$$\Delta\omega_1=\omega_1 \tag{20}$$

$$\Delta\omega_i=\omega_i-\omega_{i-1};\ 1<i<N(1)+1 \tag{21}$$

The set of values N(1), N(2), etc, defines the partitioning of the LSP vector into subvectors. In the exemplary embodiment with N=10, the LSP vector is partitioned into 5 subvectors of 2 elements each, such that N(1)=2, N(2)=4, N(3)=6, N(4)=8, and N(5)=10. V is defined as the number of subvectors, so in the exemplary embodiment V=5.

In alternate embodiments, the LSP vector can be partitioned into different numbers of subvectors of differing dimension. For example, a partitioning into 3 subvectors with 3 elements in the first subvector, 3 elements in the second subvector, and 4 elements in the third subvector would result in N(1)=3, N(2)=6, and N(3)=10. In this alternative embodiment V=3.

After the first subvector of LSP differences is computed in subtractor 15a, it is quantized by elements 16a, 17a, 18a, and 19a. Element 18a is a codebook of LSP difference vectors. In the exemplary embodiment there are 64 such vectors. The codebook of LSP difference vectors can be determined using well known vector quantization training algorithms. Index generator 1, element 17a, provides a codebook index, m, to codebook element 18a. Codebook element 18a in response to index m provides the mth codevector, made up of elements $\Delta\omega_1(m), \ldots, \Delta\omega_{N(1)}(m)$.

Error computation and minimization element 16a computes the sensitivity weighted error, E(m), which represents the approximate spectral distortion which would be incurred by quantizing the original subvector of LSP differences to this mth codevector of LSP differences. E(m) is computed using the following loop structure:

| | | |
|---|---|---|
| err=0; | | (22) |
| E(m)=0; | | (23) |
| for k= 1 to N(1) | | (24) |
| | $err = err+\Delta\omega_k-\Delta\omega_k(m)$ | (25) |
| | $E(m) = E(m) + S_k\, err^2$ | (26) |
| end loop | | (27) |

The procedure for determining the sensitivity weighted error, illustrated in equations 22–27, accumulates the quantization error in each LSP frequency and weights that error by the sensitivity.

Once E(m) has been computed for all codevectors in the codebook, error computation and minimization (ERROR COMP. AND MINL) element 16a selects the index m, which minimizes E(m). This value of m is the selected index to codebook 1, and is referred to as $I_1$. The quantized values of $\Delta\omega_1, \ldots, \Delta\omega_{N(1)}$ are denoted by $\overline{\Delta\omega_1} \ldots \overline{\Delta\omega_{N(1)}}$, and are set equal to $\Delta\omega_1(I_1), \ldots, \Delta\omega_{N(1)}(I_1)$.

In summer element 19a, the quantized LSP frequencies in the first subvector are computed as:

$$\overline{\omega_i} = \sum_{k=1}^{i} \overline{\Delta\omega_i}. \tag{28}$$

The quantized LSP frequency $\overline{\omega_{N(1)}}$ computed in block 19a, and the $\omega_i$ for i from N(1)+1to N(2) are used to compute the second subvector of LSP differences, comprising $\Delta\omega_{N(1)+1}, \Delta\omega_{N(1)+2}, \ldots \Delta\omega_{N(2)}$ as follows:

$$\Delta\omega_1=\omega_{N(1)+1}-\overline{\omega_{N(1)}} \tag{29}$$

$$\Delta\omega_i=\omega_i-\omega_{i-1};\ N(1)<i<N(2)+1 \tag{30}$$

The operation for selecting the second index value $I_2$ is performed in the same way as described above for selecting $I_1$.

The remaining subvectors are quantized sequentially in a similar manner. The operation for all of the subvectors is essentially the same and for instance the last subvector, the Vth subvector, is quantized after all of the subvectors from 1 to V−1 have been quantized. The Vth subvector of LSP differences is computed by an element 15V as $$\Delta\omega_{N(V-1)+1}=\omega_{N(V-1)+1}-\overline{\omega_{N(V-1)}} \tag{31}$$

$$\Delta\omega_i=\Delta\omega_i-\Delta\omega_{i-1};\ N(V-1)<i<N(V)+1 \tag{32}$$

The Vth subvector is quantized by finding the codevector in the Vth codebook which minimizes E(m), which is computed by the following loop:

| | | |
|---|---|---|
| err=0; | | (33) |
| E(m)=0; | | (34) |
| for k= N(V−1)+1 to N(V) | | (35) |
| | $err = err+\Delta\omega_k-\Delta\omega_k(m)$ | (36) |
| | $E(m) = E(m) + S_k\, err^2$ | (37) |
| end loop | | (38) |

Once the best codevector for the Vth subvector is determined, the quantized LSP differences and the quantized LSP frequencies for that subvector are computed as described above. This procedure is repeated sequentially until all of the subvectors are quantized.

In FIGS. 1 and 2, the blocks may be implemented as structural blocks to perform the designated functions or the blocks may represent functions performed in programming of a digital signal processor (DSP) or an application specific integrated circuit ASIC. The description of the functionality of the present invention would enable one of ordinary skill to implement the present invention in a DSP or an ASIC without undue experimentation.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. An apparatus for efficient determination of LSP quantization sensitivities using closed form analysis, comprising:

polynomial division means for receiving a set of line spectral pair (LSP) frequencies and a set of linear prediction coding (LPC) coefficients and for generating a set of quotient coefficients in accordance with a predetermined polynomial division format; and sensitivity cross correlation means for receiving said set of quotient coefficients and a set of speech auto correlation coefficients and for computing a set of LSP sensitivity coefficients in accordance with a weighted cross-correlation computation format.

2. The apparatus of claim 1 further comprising a sensitivity autocorrelation means disposed between said polynomial division means and said sensitivity cross correlation means for receiving said set of quotient coefficients and generating a set of sensitivity autocorrelation values for said set of quotient coefficients in accordance with a predetermined autocorrelation computation format.

3. The apparatus of claim 1 further comprising a vector computation means disposed before said polynomial division means for receiving said set of LPC coefficients and generating a set of LSP vectors in accordance with a predetermined vector generation format.

4. The apparatus of claim 3 wherein said vector computation means computes two vectors P and Q in said set of vectors in accordance with the equations:

$$P(0) = 1$$
$$P(N+1) = 1$$
$$P(i) = -a(i) - a(N+1-i) \quad 0 < i < N+1$$

$$Q(0) = 1$$
$$Q(N+1) = -1$$
$$Q(i) = -a(i) + a(N+1-i); \quad 0 < i < N+1.$$

5. The apparatus of claim 4 wherein said polynomial division means provides said set of quotient coefficients $J_i$ for odd LSP frequencies in accordance with the equation:

$$x^2 - 2 \cdot \cos(\omega_i) \cdot$$

$$x+1 \quad \frac{J_i(N-1)x^{N-1} + J_i(N-2)x^{N-2} + \ldots + J_i(1)x + J_i(0)}{\sqrt{P(N+1)x^{N+1} + P(N)x^N + \ldots + P(1)x + P(0)}}$$

where x is the polynomial variable, $\omega_i$ is the ith LSP frequency, and N is the number of filter taps.

6. The apparatus of claim 4 wherein said polynomial division means provides said set of quotient coefficients $J_i$ for even LSP frequencies in accordance with the equation:

$$x^2 - 2 \cdot \cos(\omega_i) \cdot$$

$$x+1 \quad \frac{J_i(N-1)x^{N-1} + J_i(N-2)x^{N-2} + \ldots + J_i(1)x + J_i(0)}{\sqrt{Q(N+1)x^{N+1} + Q(N)x^N + \ldots + Q(1)x + Q(0)}}$$

where x is the polynomial variable, $\omega_i$ is the ith LSP frequency, and N is the number of filter taps.

7. The apparatus of claim 1 wherein said sensitivity cross correlation means provides said LSP sensitivity values in accordance with the equation:

$$S_i = \sin^2(\omega_i) \cdot \left[ R(0) \cdot R_{Ji}(0) + 2 \cdot \sum_{k=1}^{N} R(k) \cdot R_{Ji}(k) \right]$$

where $\omega_i$ is the ith LSP frequency, R(k) is the kth speech autocorrelation coefficient of the set of speech samples and $R_{Ji}(k)$ is the kth autocorrelation coefficient of said set of quotient coefficients.

8. An apparatus for quantizing line spectral pair (LSP) frequencies comprising:

line spectral pair (LSP) sensitivity generation means for receiving a set of line spectral pair (LSP) frequencies, a set of linear prediction coding (LPC) coefficients, and for efficiently computing a set of LSP sensitivity coefficients in accordance with a weighted cross-correlation closed form computation format; and quantization means for receiving said set of LSP frequencies and said set of LSP sensitivity coefficients and for selecting a set of quantized LSP frequencies in accordance with a sensitivity weighted error computation format.

9. The apparatus of claim 8 further comprising subtractor means disposed before said quantization means for receiving said set of LSP frequencies and for providing a set of differential LSP frequencies in accordance with a predetermined difference format and wherein said quantization means is for selecting a set of quantized differential LSP frequencies.

10. The apparatus of claim 8 wherein said quantization means comprises:

index generator means for providing an index value;

codebook means for receiving said index value and for providing a corresponding quantization vector; and error computation means for receiving said set of sensitivity values, said set of LSP frequencies and said quantization vector and determining a weighted quantization error.

11. The apparatus of claim 8 wherein said sensitivity weighted error computation format accumulates a quantization error for each LSP frequency of said set of LSP frequencies and weights the resulting error by a corresponding sensitivity of said set of sensitivities.

12. An apparatus of claim 11 for determining LSP quantization sensitivities comprising:

a polynomial divider that receives a set of line spectral pair (LSP) frequencies and a set of linear prediction coding (LPC) coefficients and generates a set of quotient coefficients in accordance with a predetermined polynomial division format; and a sensitivity cross-correlator that receives said set of quotient coefficients and a set of speech auto correlation coefficients and computes a set of LSP sensitivity coefficients in accordance with a weighted cross-correlation computation format.

13. The apparatus of claim 12 further comprising a sensitivity autocorellator disposed between said polynomial divider and said sensitivity cross-correlator that receives said set of quotient coefficients and generates a set of sensitivity autocorrelation values for said set of quotient coefficients in accordance with a predetermined autocorrelation computation format.

14. The apparatus of claim 12 further comprising a vector calculator disposed before said polynomial divider that receives said set of LPC coefficients and generates a set of vectors in accordance with a predetermined vector generation format.

15. The apparatus of claim 14 wherein said vector calculator calculates two vectors P and Q in said set of vectors in accordance with the equations:

$$P(0) = 1$$
$$P(N+1) = 1$$
$$P(i) = -a(i) - a(N+1-i) \quad 0 < i < N+1$$

$$Q(0) = 1$$
$$Q(N+1) = -1$$
$$Q(i) = -a(i) + a(N+1-i); \quad 0 < i < N+1.$$

16. The apparatus of claim 15 wherein said polynomial divider provides said set of quotient coefficients $J_i$ for odd LSP frequencies in accordance with the equation:

$$x^2 - 2 \cdot \cos(\omega_i) \cdot$$

$$x+1 \quad \frac{J_i(N-1)x^{N-1} + J_i(N-2)x^{N-2} + \ldots + J_i(1)x + J_i(0)}{\sqrt{P(N+1)x^{N+1} + P(N)x^N + \ldots + P(1)x + P(0)}}$$

where x is the polynomial variable, $\omega_i$ is the ith LSP frequency, and N is the number of filter taps.

17. The apparatus of claim 15 wherein said polynomial division means provides said set of quotient coefficients $J_i$ for even LSP frequencies in accordance with the equation:

$$x^2 - 2 \cdot \cos(\omega_i) \cdot \frac{J_i(N-1)x^{N-1} + J_i(N-2)x^{N-2} + \ldots + J_i(1)x + J_i(0)}{x+1 \sqrt{Q(N+1)x^{N+1} + Q(N)x^N + \ldots + Q(1)x + Q(0)}}$$

where x is the polynomial variable, $\omega_i$ is the ith LSP frequency, and N is the number of filter taps.

18. The apparatus of claim 12 wherein said sensitivity cross correlation means provides said LSP sensitivity values in accordance with the equation:

$$S_i = \sin^2(\omega_i) \cdot \left[ R(0) \cdot R_{Ji}(0) + 2 \cdot \sum_{k=1}^{N} R(k) \cdot R_{Ji}(k) \right]$$

where $\omega_i$ is the ith LSP frequency, R(k) is the kth speech autocorrelation coefficient of the set of speech samples and $R_{Ji}(k)$ is the kth autocorrelation coefficient of said set of quotient coefficients.

19. An apparatus for quantizing line spectral pair (LSP) frequencies comprising:

LSP sensitivity generator that receives a set of line spectral pair (LSP) frequencies, a set of linear prediction coding (LPC) coefficients, and for computing a set of LSP sensitivity coefficients in accordance with a weighted cross-correlation computation format; and LSP quantizer for receiving said set of LSP frequencies and said set of LSP sensitivity coefficients and for selecting a set of quantized LSP frequencies in accordance with a sensitivity weighted error computation format.

20. The apparatus of claim 19 further comprising subtractor disposed before said LSP quantizer that receives said set of LSP frequencies and provides a set of differential LSP frequencies in accordance with a predetermined difference format and wherein said LSP quantizer selects a set of quantized differential LSP frequencies.

21. The apparatus of claim 19 wherein said LSP quantizer comprises:

an index generator that provides an index value;

a codebook that receives said index value and for provides a corresponding quantization vector; and a error computer that receives said set of sensitivity values, said set of LSP frequencies and said quantization vector and determines a weighted quantization error.

22. The apparatus of claim 19 wherein said sensitivity weighted error computation format accumulates a quantization error for each LSP frequency of said set of LSP frequencies and weights the resulting error by a corresponding sensitivity of said set of sensitivities.

23. A method for efficient determination of LSP quantization sensitivities using closed form analysis, comprising the steps of:

receiving a set of line spectral pair (LSP) frequencies and a set of linear prediction coding (LPC) coefficients;

generating a set of quotient coefficients in accordance with a predetermined polynomial division format; and computing a set of LSP sensitivity coefficients in accordance with a weighted cross-correlation computation format.

24. The method of claim 23 further generating a set of sensitivity autocorrelation values for said set of quotient coefficients in accordance with a predetermined autocorrelation computation format.

25. The method of claim 23 further comprising generating a set of LSP vectors in accordance with a predetermined vector generation format.

26. The method of claim 25 wherein said step of vector generation comprises providing a P vector and a Q vector of dimension N defined as:

| | |
|---|---|
| P(0) = 1 | |
| P(N+1) = 1 | |
| P(i) = −a(i) − a(N+1−i) | 0<i<N+1 |
| Q(0) = 1 | |
| Q(N+1) = −1 | |
| Q(i) = −a(i) + a(N+1−i); | 0<i<N+1. |

27. The method of claim 26 wherein said stop of generating said set of quotient coefficients $J_i$ provides said quotient coefficients for odd LSP frequencies in accordance with the equation:

$$x^2 - 2 \cdot \cos(\omega_i) \cdot \frac{J_i(N-1)x^{N-1} + J_i(N-2)x^{N-2} + \ldots + J_i(1)x + J_i(0)}{x+1 \sqrt{P(N+1)x^{N+1} + P(N)x^N + \ldots + P(1)x + P(0)}}$$

where x is the polynomial variable, $\omega_i$ is the ith LSP frequency, and N is the number of filter taps.

28. The method of claim 26 wherein said polynomial division means provides said set of quotient coefficients $J_i$ for even LSP frequency values in accordance with the equation:

$$x^2 - 2 \cdot \cos(\omega_i) \cdot \frac{J_i(N-1)x^{N-1} + J_i(N-2)x^{N-2} + \ldots + J_i(1)x + J_i(0)}{x+1 \sqrt{Q(N+1)x^{N+1} + Q(N)x^N + \ldots + Q(1)x + Q(0)}}$$

where x is the polynomial variable, $\omega_i$ is the ith LSP frequency, and N is the number of filter taps.

29. The method of claim 23 wherein said step of providing said LSP sensitivity values provides said sensitivity values in accordance with the equation:

$$S_i = \sin^2(\omega_i) \cdot \left[ R(0) \cdot R_{Ji}(0) + 2 \cdot \sum_{k=1}^{N} R(k) \cdot R_{Ji}(k) \right]$$

where $\omega_i$ is the ith LSP frequency, R(k) is the kth speech autocorrelation coefficient of the set of speech samples and $R_{Ji}(k)$ is the kth autocorrelation coefficient of said set of quotient coefficients.

30. A method for quantizing line spectral pair (LSP) frequencies, comprising the steps of:

receiving a set of line spectral pair (LSP) frequencies and a set of linear prediction coding (LPC) coefficients; generating a set of quotient coefficients in accordance with a predetermined polynomial division format;

computing a set of LSP sensitivity coefficients in accordance with a weighted cross-correlation closed form computation format; and selecting a set of quantized LSP frequencies in accordance with a sensitivity weighted error computation format.

31. The method of claim 30 further comprising the step of providing a set of differential LSP frequencies in accordance with a predetermined difference format.

32. The method of claim 30 wherein said step of quantizing said LSP coefficients comprises the steps of:

providing a quantization vector; and determining a weighted quantization error in accordance with said set of sensitivity values, said set of LSP frequencies and said quantization vector.

33. The method of claim 30 wherein said sensitivity weighted quantization error computation format accumulates a quantization error for each LSP frequency of said set of LSP frequencies and weights the resulting error by a corresponding sensitivity of said set of sensitivities.

* * * * *